US007213307B2

(12) United States Patent
Votel

(10) Patent No.: US 7,213,307 B2
(45) Date of Patent: May 8, 2007

(54) CLIP

(75) Inventor: Thomas F. Votel, Sunfish Lake, MN (US)

(73) Assignee: Ergodyne Corporation, St. Paul, MN (US)

( * ) Notice: Subject to any disclaimer, the term of this patent is extended or adjusted under 35 U.S.C. 154(b) by 0 days.

(21) Appl. No.: 11/132,505

(22) Filed: May 19, 2005

(65) Prior Publication Data

US 2006/0260105 A1 Nov. 23, 2006

(51) Int. Cl.
*A44B 21/00* (2006.01)

(52) U.S. Cl. ..... 24/545; 24/557; 24/336; 24/341

(58) Field of Classification Search ..... 24/343, 24/327, 335, 336, 545, 340, 3.13, 539, 329
See application file for complete search history.

(56) References Cited

U.S. PATENT DOCUMENTS

| | | | | | |
|---|---|---|---|---|---|
| 0,926,301 | A | | 6/1909 | Sveich | |
| 2,487,339 | A | | 8/1949 | Kindlund et al. | |
| 2,585,089 | A | * | 2/1952 | Caldwell et al. | 24/559 |
| 4,226,105 | A | | 10/1980 | Wehrman | |
| 4,966,344 | A | * | 10/1990 | Gary | 248/317 |
| 5,142,807 | A | | 9/1992 | Sweet | |
| D368,169 | S | | 3/1996 | Coker | |
| 5,655,270 | A | | 8/1997 | Boisvert | |
| 5,687,458 | A | * | 11/1997 | Coker | 24/336 |
| 5,697,572 | A | | 12/1997 | Salentine et al. | |
| 5,722,125 | A | | 3/1998 | Vasilopoulos | |
| 6,056,173 | A | | 5/2000 | Gillespie | |
| 6,161,266 | A | * | 12/2000 | Anscher | 24/625 |
| 6,212,688 | B1 | | 4/2001 | Leslie | |
| 6,216,319 | B1 | | 4/2001 | Elkins | |
| 6,256,840 | B1 | | 7/2001 | Elliott | |
| D478,723 | S | | 8/2003 | Blanton | |
| 6,631,538 | B1 | | 10/2003 | Carr | |
| 6,682,249 | B2 | | 1/2004 | Rietz | |
| 2005/0011981 | A1 | * | 1/2005 | Baumgarten | 242/377 |

FOREIGN PATENT DOCUMENTS

| | | |
|---|---|---|
| CA | 481 602 | 3/1952 |
| DE | 390 558 | 2/1924 |
| DE | 806 473 | 6/1951 |
| GB | 1 319 612 | 6/1973 |

* cited by examiner

*Primary Examiner*—Robert J. Sandy
*Assistant Examiner*—Marcus Menezes
(74) *Attorney, Agent, or Firm*—Patterson, Thuente, Skaar & Christensen P.A.

(57) ABSTRACT

A clip having structure for detachably interlocking with another clip and which can be used to secure items to garments being worn by a user. The instant clips may be made from a resilient material and include a base structure defining an aperture and a gap, which enable the detachable interlinking. The jaw members are forced apart by the user applying opposing forces to each of the arms and grasp the article when the arms are released.

17 Claims, 7 Drawing Sheets

$L_A$
$L_W$
100
102
104
106
110
112
114
116
118
120
122
124
126
128
130
132
134
136
138
140
142
144
146
148
150
152
154

CLIP

CROSS-REFERENCES TO RELATED APPLICATIONS

This application is related to copending and concurrently filed U.S. Design Patent Applications 29/230,286 and 29/230,291, each hereby incorporated by reference.

FIELD OF THE INVENTION

This invention relates to devices for securing unused articles to a user and, in particular, 'this invention relates to detachably interlocking devices for securing unused articles to a user's garment.

BACKGROUND

Persons at work sites, or otherwise, frequently carry articles, such as gloves, hats, jackets, or the like which are intermittently needed. When not needed, these articles must either be stored away from the person or be disposed in the person's pockets. When stored away from the person, the articles may be lost or taken by other persons. Additionally, these articles are not immediately available for use. If stored in the pockets of the person, these articles may fallout or otherwise become lost, thereby necessitating replacement and thereby becoming unavailable to the person.

There is then a need for a device to enable unused articles to be stored on the user's garments. There is a particular need for a device to quickly and securely attach unneeded articles to the user's clothing so that the articles are immediately available when needed.

SUMMARY OF THE INVENTION

This invention substantially meets the aforementioned needs of the industry by providing a combination of detachably interlinked clips, which securely attach unneeded articles to a user's clothing such that the articles are immediately available when needed.

The present invention provides a clip for securing an article, such as a glove, a hat, a jacket, or the like, to a garment worn by a user so that the article will be readily available to the user and will not be misplaced or lost. The present invention also provides a pair of clips, which can be detachably interlinked, one of the clips attached to a garment of the user, another of the clips used to attach the article.

One embodiment of the clip of this invention has a base and first and second arms. The base defines an aperture and a gap opening into the aperture such that the gap resiliently admits base of another clip or similarly dimensioned device through the gap and into the aperture to be detachably interlinked. The first and second arms may include a gripping portion extending from the base and a first jaw portion in mechanical communication with a gripping portion. The first and second arms may be biased in a closed position in which the first jaw portions are in a contacting relation. A force exerted on the first and second gripping portions forces the first jaw portions apart into a noncontacting relation. The instant clips may be interlinked by aligning the gaps of the clips, then applying a force such that the clips are displaced via the gaps and become interlinked.

Another embodiment of the clip of this invention includes a base and the first and second arms. The base, in turn, includes a central portion and a pair of base extensions, extending from the central portion. The central portion and base extensions may define an aperture and a gap, the gap opening into the aperture. The first and second arms may extend from the base. The second arm may terminate in a generally transverse arm extension in one embodiment.

Another embodiment of the instant invention includes a clip assembly, which includes a structure which may be detachably interlinked with the clip of this invention. The clip assembly may include a reel subassembly and an optional buckle subassembly. The reel subassembly includes a tether wound around a reel, the reel disposed within a housing. If present, the buckle assembly is attached to a free end of the tether, and may include a structure dimensionally configured to be detachably interlinked with the clip of this invention, such as a ring.

The clip of this invention may further include a jaw portion at one end of each of the clip arms. When this embodiment of the clip of this invention is in a closed position, the jaw portions are in a contacting relation. When the embodiment of this clip is in an open position, the jaw portions are in a non-contacting relation.

The clip of this invention may further include retaining structure at the tip of each jaw portion. This retaining structure may be a groove laterally aligned with a projection. Thus, when the instant clip is in the closed position the projection in one jaw portion is accommodated in the groove of the other jaw portion.

It is a feature of this invention that the instant clips will include a detachably interlinking structure, such as an aperture defined by a flexibly resilient base and a gap opening into the aperture. It is an advantage of the foregoing feature that a pair of clips can be interlinked or separated as desired.

It is another feature of this invention, that a significant degree of force is required to interlink, or to detach, the instant clips. It is an advantage of the foregoing feature that interlinked clips are unlikely to become accidentally detached. It is another advantage of the foregoing feature that articles secured by the instant clips to a user's garment are unlikely to become accidentally lost.

It is another feature of one embodiment of this invention, that the jaw portions may include retaining structure, such as a groove laterally aligned with a projection, a projection from one jaw portion being disposed in a groove of an opposing jaw portion when the instant clip is in a closed position. It is an advantage of the foregoing feature that the shape, beveled edges present in the retaining structure further help to retain the item being retained.

It is another feature of one embodiment of this invention to include a generally transverse terminal arm extension at the end of at least one arm. It is an advantage of the foregoing feature that the transverse terminal extension helps retain the clip to a user's garment.

These and other objects, features, and advantages of this invention will become apparent from the description which follows, when considered in view of the accompanying drawings.

BRIEF DESCRIPTION OF THE DRAWINGS

FIG. 1*f* is a plan view of another embodiment of a clip of this invention.

FIG. 1*g* side view of the clip of FIG. 1*f*.

Figure 1A:
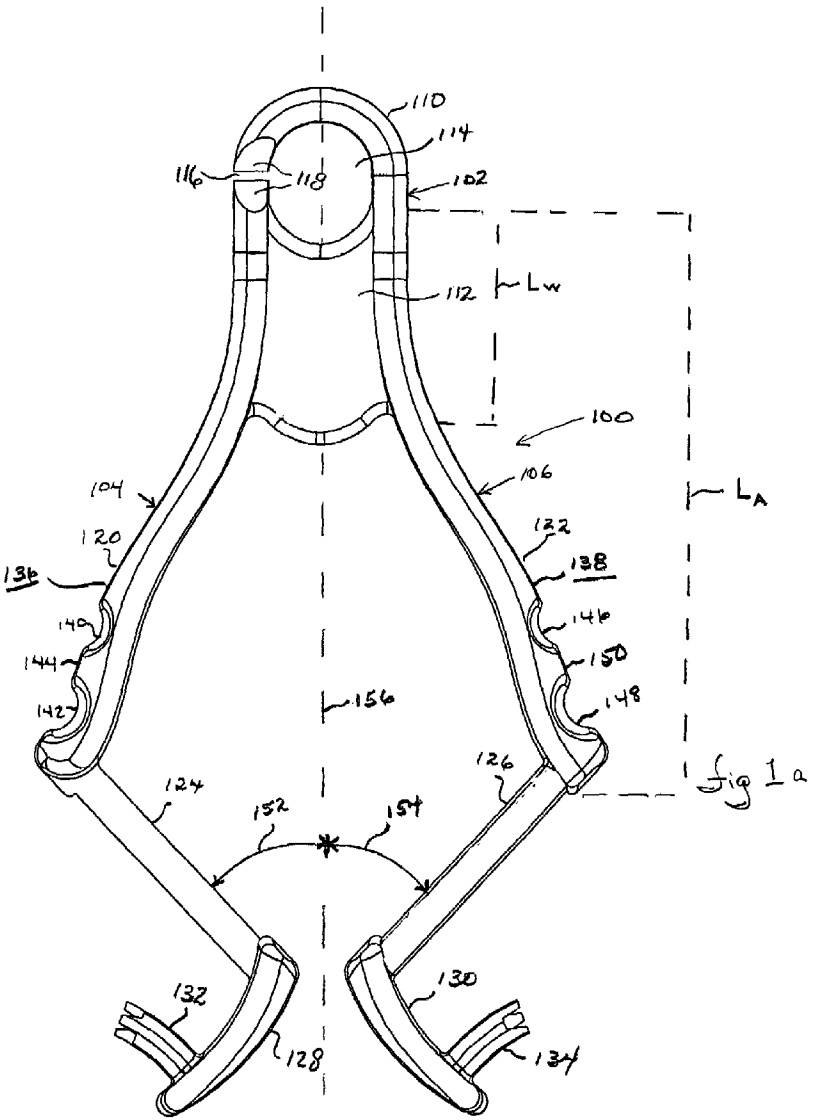
FIG. 1*a* is a side view of an embodiment of a clip of this invention as a non-assembled configuration.

It is understood that the above-described figures are only illustrative of the present invention and are not contemplated to limit the scope thereof.

DETAILED DESCRIPTION

Unless otherwise defined, all technical and scientific terms used herein have the same meaning as commonly understood by one of ordinary skill in the art to which this invention belongs. In case of conflict, the present specification, including definitions, will control. Although methods and materials similar or equivalent to those described herein can be used to practice the invention, suitable methods and materials are described below. In addition, the materials, methods, and examples are illustrative only and are not intended to be limiting.

Any references to such relative terms as inner and outer and the like, are intended for convenience of description and are not intended to limit the present invention or its components to any one positional or spatial orientation. All dimensions of the components in the attached figures may vary with a potential design and the intended use of an embodiment of the invention without departing from the scope of the invention.

An embodiment of a first clip of this invention in a non-assembled configuration is depicted in FIGS. 1*a*–1*e* at 100 and includes a base 102 and arms 104 and 106. The base 102, in turn, has a rim 110 and a web 112. In the embodiment depicted, the rim 110 is generally continuous with each of the arms 104 and 106. The web 112 is unitary, or otherwise integral, with inner surfaces of the arms 104 and 106 in this embodiment. In an exemplary and detachably interlinking structure, the rim 110 and web 112 define an aperture 114 and the rim 110 further defines a gap 116 at beveled edges 118.

The arms 104 and 106, respectively, unitarily, or otherwise integrally, extend from the rim 110 and are maintained by the rim 110 and web 112 so as to be resiliently biased in a closed position when fully assembled. The arms 104 and 106, in turn, respectively and unitarily (or otherwise integrally) include first gripping portions 120 and 122, angular second portions 124 and 126, second jaw portions 128 and 130, and first jaw portions 132 and 134. In the embodiment depicted, the first gripping portions 120 and 122 generally taper from a maximum width proximate the junctions with the angular second portions 124 and 126 to a minimum width where the first gripping portions 120 and 122 adjoin the rim 110. As also depicted, the first gripping portions 122 and 124 of this embodiment display outer surfaces 136 and 138, respectively. Cavities 140 and 142 and a ridge 144 therebetween are defined by the outer surface 136 and cavities 146 and 148 and a ridge 150 therebetween are defined by the outer surface 138, e.g., to enhance gripping and/or for aesthetic appeal. Obviously, the scope of this invention includes other structures to enhance gripping and/or aesthetic appeal as well. The arms 104 and 106 are dimensioned to enable the clip of this invention to be opened with a minimum of effort, yet grip articles being held securely. By way of illustration and not limitation, the first gripping portions 120 and 122 may taper from a maximum width between about 17.5 mm and 27.5 mm, between about 20.0 mm and 25 mm, or about 22.5 mm to a minimum width between about 5 mm and 9 mm, between about 6 mm and 8 mm, or about 7 mm. Moreover, the first gripping portions may have a thickness between about 2.5 mm and 4.5 mm, between about 3.0 mm and 4.5 mm, or between about 3.5 mm. The web 112 is dimensioned with a length $L_W$ and at least one of the flexing portions, e.g., the first gripping portions 120 and 122, is dimensioned with a length $L_A$ such that the proper amount of tension is exerted to force the jaw elements together. In some embodiments, a ratio of the first gripping portions lengths $L_A$ to the web length $L_W$ is between about 5 and 15, between about 7.5 and 12.5, or about 10.4. Obviously, the dimensions of any specific embodiment of the instant clip, may be determined by factors such as the dimensions and weight of articles to be held, materials used in manufacturing the clip of this invention, and the like.

The second angular portions 124 and 126 obtusely extend from the gripping portions 120 and 122, respectively. However, the second portions may extend generally perpendicularly or acutely from the gripping portions in other embodiments. Stated otherwise and in the embodiment shown, the angular relation of the second portions 124 and 126 to the gripping portions 120 and 122, respectively may be described by respective angles 152 and 154 between the second portions and a longitudinal axis 156. The angles 152 and 154 may be between about 33.7 and 53.7 degrees, between about 38.7 and 48.7 degrees, or about 43.7 degrees in the embodiment shown. Also in the embodiment shown, the angular portions 124 and 126 have a maximum width where they unitarily, or otherwise integrally, adjoin the gripping portions 120 and 122 and taper to a minimum width where they unitarily or otherwise integrally, adjoin the second jaw portions 128 and 130. Additionally, the embodiment depicted has the angular portion 124 extending from one-half of the end of the gripping portion 120 and from one-half of the end of the second jaw portion 128. Although not shown, the angular portion 126 may extend from one-half of the gripping portion 122 and from one-half of the end of the second jaw portion 130.

Figure 2C:
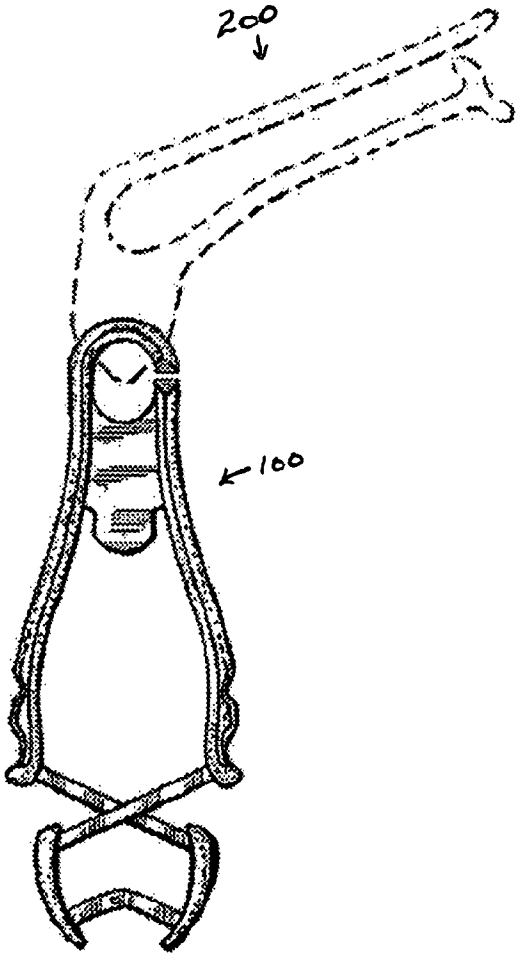
FIG. 2*c* is a side view of the clip of FIG. 1 detachably interlinked to the clip of FIG. 2*a*.
Figure 2B:
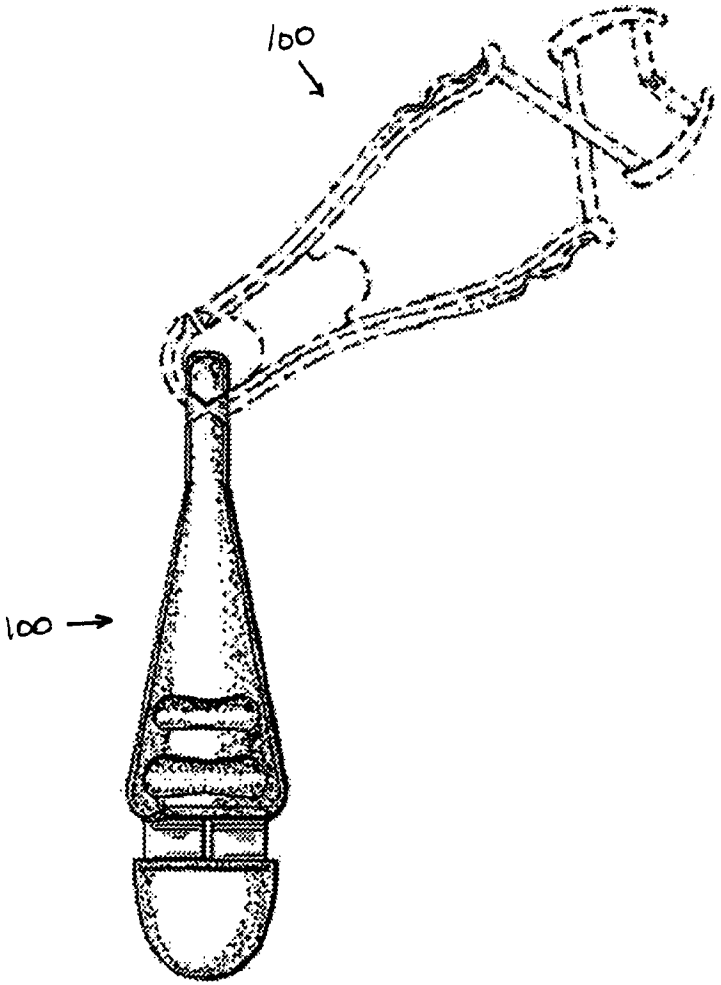
FIG. 2*b* is a side view of the clip of FIG. 1 detachably interlinked to the clip of FIG. 2*a*.

As can be seen in FIGS. 2*b* and 2*c*, the second jaw portions 128 and 130 are generally convex as viewed from the side in this embodiment, having a maximum width where they adjoin the angular portions 124 and 126 and tapering to a rounded tip. The first jaw portions 132 and 134 unitarily, or otherwise integrally, adjoin the second jaw portions proximate to, but not at, the rounded tips and so as to contact each other at an inward and oblique angle when in a closed, assembled configuration. The inward and oblique angle of contact with respect to the first jaw portions 132 and 134 advantageously acts to maintain articles such as gloves secured therebetween by opposing outward forces exerted on the articles. Indeed rather than tending to open the instant clip, outward forces would tend to urge the first jaw portions 132 and 134 toward each other further securing the article between the jaw portions 132 and 134. Because of the enhanced utility of the angled jaw portions of this invention to grip and retain articles being held, the gripping portions 120 and 122 may be dimensioned and made of materials allowing the instant clip to be opened with less force than if the instant jaw portions were not so angled.

Figure 1C:
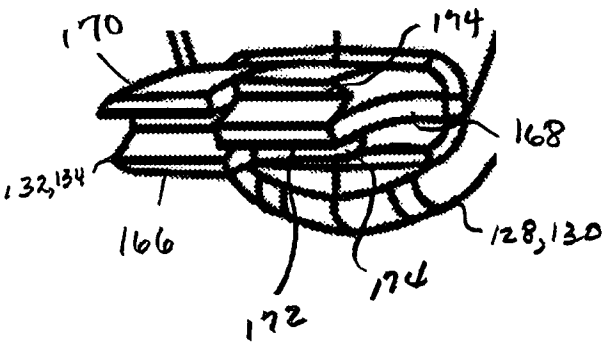
FIGS. 1*b*, 1*c*, 1*d*, and 1*e* are perspective views of the retaining structure present in the embodiment of FIG. 1*a*.
Figure 1D:
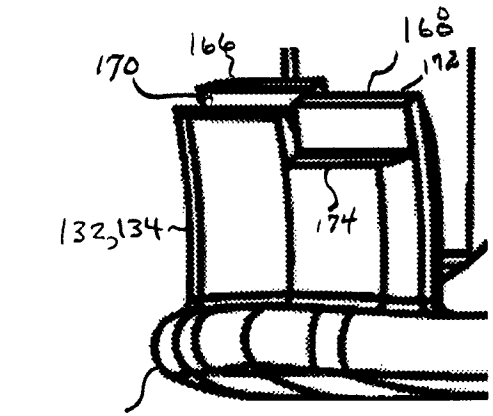
Figure 1B:
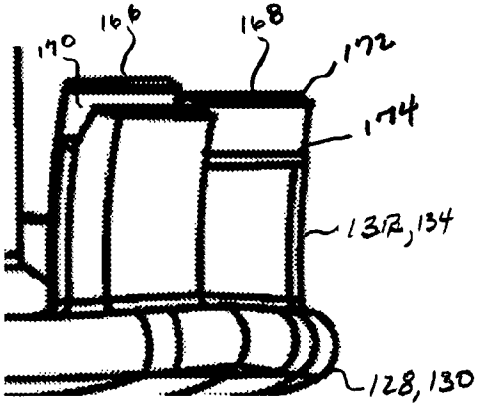
Figure 1E:
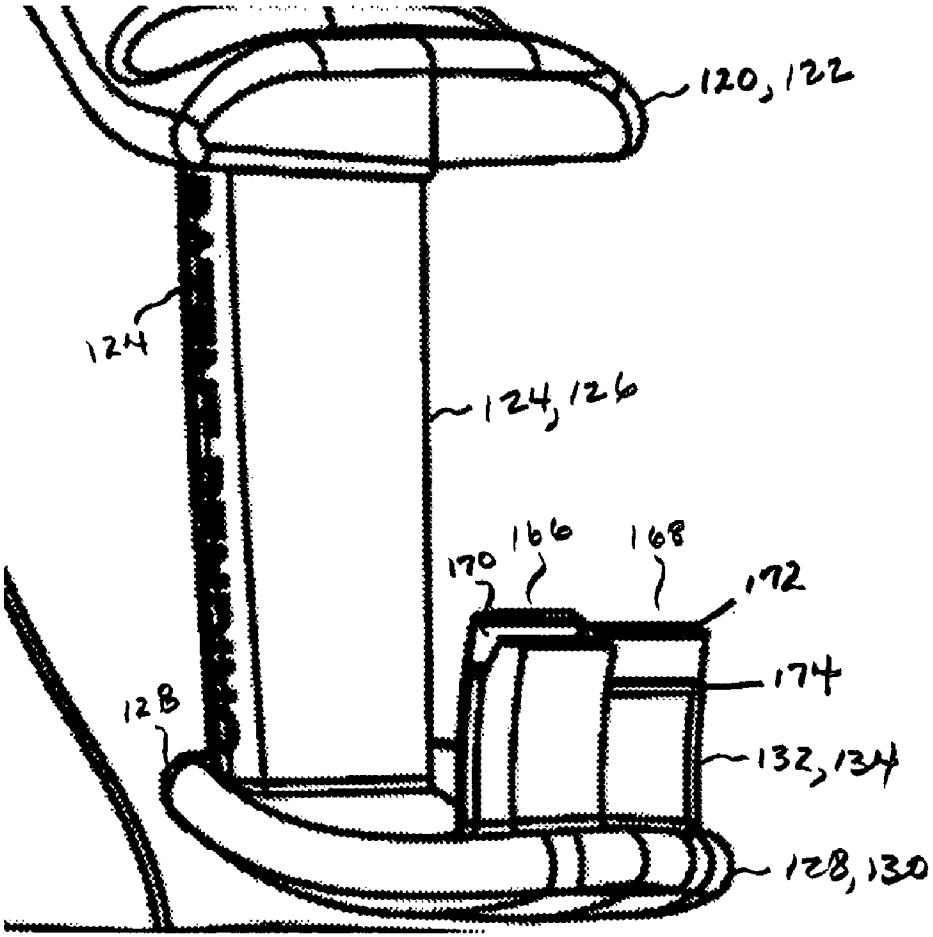
Figure 16:
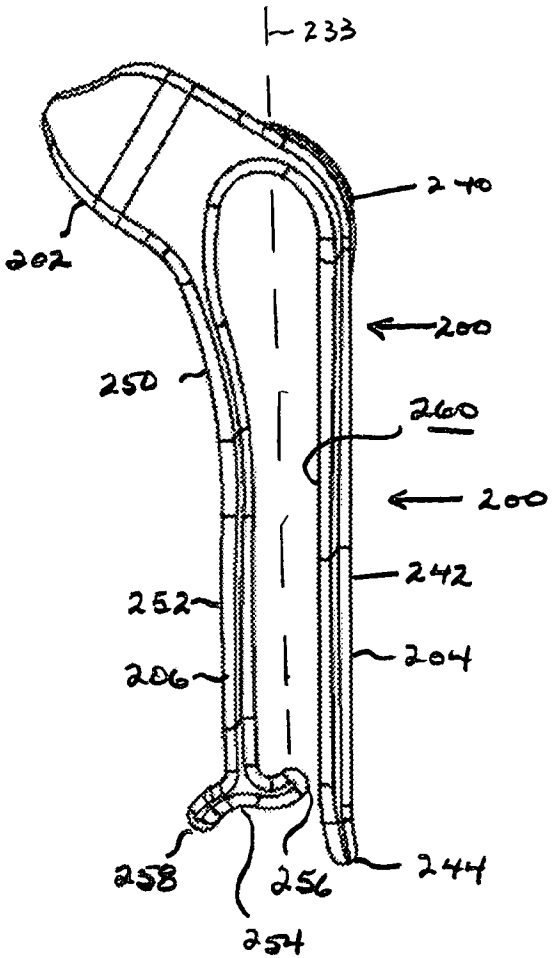
Figure 14:
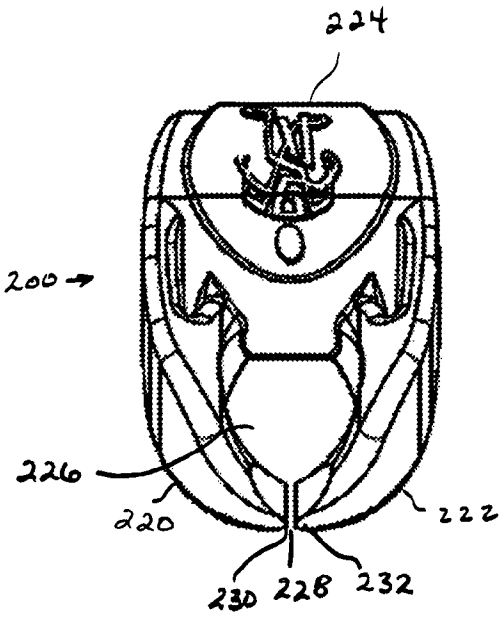

Referring to FIGS. 1*b*-1*d*, the first jaw portions 132 and 134 may be longitudinally divided into a first-half 166 and a second-half 168. The first half 166 terminates in a retaining structure such as a slot 170. The second half terminates in a retaining structure such as a projection 172, which extends from a shoulder 174. When in an operational configuration, the first jaw portions 132 and 134 are biased in a contacting disposition, such that opposing projections 172 are accommodated in slots 170 and such that shoulders 174 are in abutting contact with the tips of the first halves 166.

Figure 3:
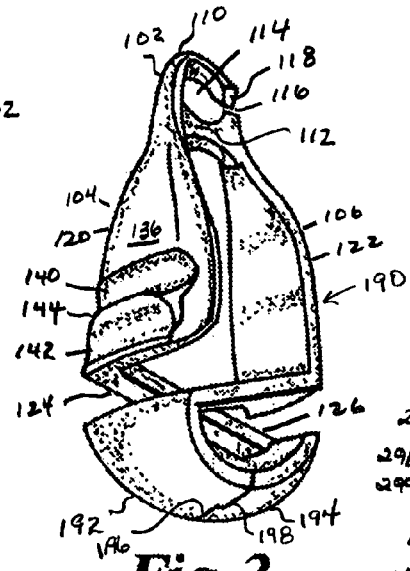
FIG. 3 is a perspective view of another embodiment of the clip of FIG. 1.
Figure 4:
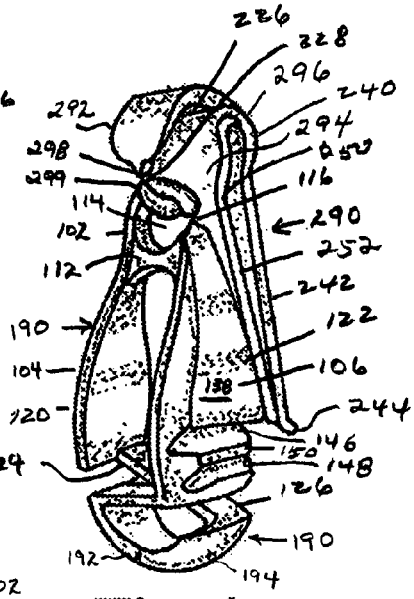
FIG. 4 is a perspective view of another embodiment of the clip of FIG. 2*a* detachably interlinked to the clip of FIG. 3.
Figure 5:
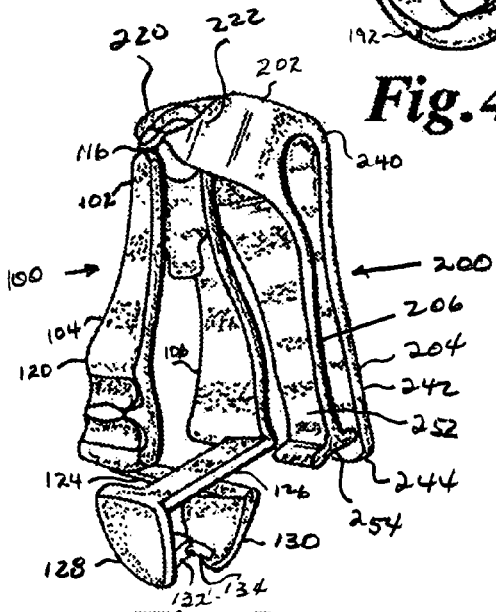
FIG. 5 is a perspective view of the clip of FIG. 2*a* detachably interlinked to the clip of FIG. 1.

Another embodiment of the instant clip is depicted in FIGS. 3 and 4 at 190. The clip 190 differs from the clip 100 in that generally concave (or other arcuate) jaw portions 192 and 194 replace the first and second jaw portions 128, 130, 132, and 134. Respective tips 196 and 198 may optionally be stepped or offset when the clip is in a closed position. Retaining structures such as the slots 170 and projections 172 may be present at the tips of the jaw portions in some embodiments.

The clip of this invention may be made by injection molding and, after being made, is in a non-operational disposition as depicted in FIG. 1. However, the resilient materials from which the instant clip is manufactured allow the clip of this invention to be configured into an operational disposition by exerting opposing forces on opposed lateral sides of the gripping portions 120 and 122, thereby forcing them apart laterally, then exerting opposing forces on the outer surfaces of the gripping portions. Finally, the first jaw portions are forced into axial alignment. In the assembled configuration, the first jaw portions are held in a contacting relation by the resiliently biased gripping portions. When in a contacting relation or closed position, the clip of this invention is biased such that the projections 172 are disposed in slots 170 of opposed first jaw portions 132 and 134. By exerting opposing forces on the outer surfaces of the gripping portions 120 and 122, the first jaw portions 132 and 134 are forced apart in a noncontacting relation, or open position.

Figure 2A:
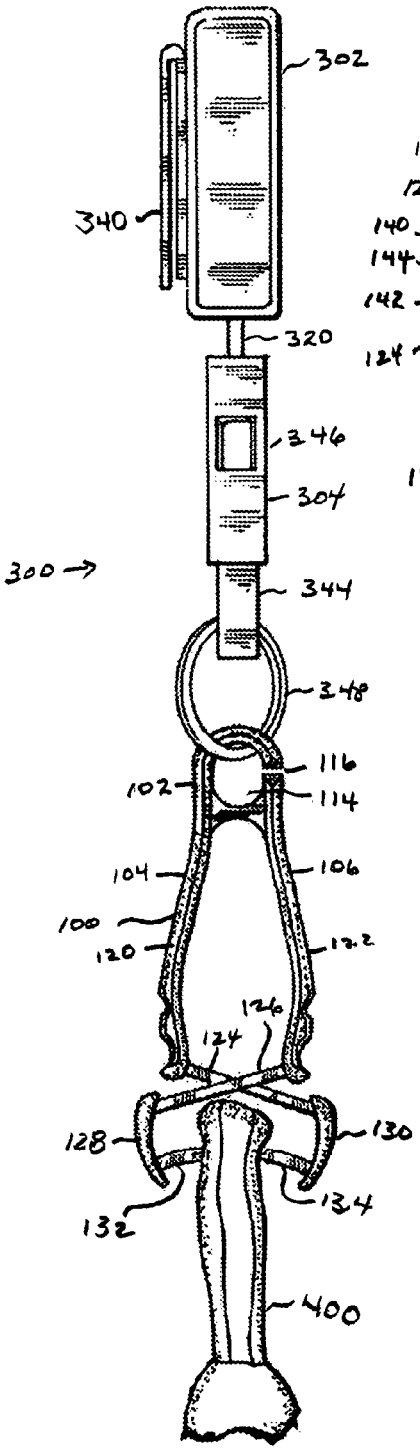
FIG. 2*a* is a side view of another embodiment of this invention.

The clips 100 and 190 are biased in a closed position and may operably manipulated to an open position during use. In the closed position, the first jaw portions 132 and 134 (or 192 and 194) are in a contacting relation such that the projections 172 are disposed in the slots 170 thereof. A user manipulates the instant clips to the open position by inwardly exerting forces on the arms 104 and 106 to force the jaw portions apart in a non-contacting relation. The user may then allow the clip of this invention to return to the closed position by relaxing the forces exerted on the clip arms and allowing the jaw portions to be displaced toward each other. If an item is not being secured by the clip, the jaw portions will resume the contacting relation. If an item is being secured, the jaws will exert a pincher force on the item to retain the item therebetween. Additionally, the securing structures present at the tips of the jaw portions will further secure the item by presenting beveled contacting edges which contact and further retain the item (FIG. 2*a*).

Referring to FIGS. 3 and 4, a second embodiment of the clip of this invention is depicted generally at 190. The clip 190 primarily differs from the clip 100 in that jaw portions 192 and 194 are present in place of the first and second jaw portions described above. The jaw portions 192 and 194 are generally arcuate as viewed from the side and, when in a contacting relation, present a generally concave geometry. The tips of the jaw portions 192 and 194 are indicated generally at 196 and 198 and, when mated, have a gripping structure to present an optional generally staggered, or stepped, appearance. While not shown, the tips of the jaw portions 192 and 194 may include a retaining structure such as described above with respect to the slot 170 and projection 172.

One embodiment of a second clip of this invention is shown in FIGS. 1*f* and 1*g* generally at 200. The second clip 200 is unitary, or otherwise integral, but may be considered to include a base 202 and arms 204 and 206. The base 202, in turn, includes generally lateral, or horizontal, extensions 220 and 222 from a central portion 224. In an exemplary detachably interlinking structure, the extensions 220 and 222 and the central portion 224 are arrayed around an aperture 226. In some embodiments, a gap 228 is defined between tips 230 and 232 of respective extensions 220 and 222. However, the tips 230 and 232 may contact each other in some embodiments. As is more fully explained below, the base 202 is advantageously angled outwardly with respect to the arms 204 and 206. One advantage of angling the base 202 in this manner is that the base is more easily grasped by a user when the clip 200 is being attached or detached from the user's belt. Another advantage is that the base 202 extends slightly away from a user as compared to an embodiment in which the base would be linearly aligned with the remainder of the clip 200. Hence the base 202 is more accessible when the clip 100 or 190 is being interlinked or detached from the clip 200 during use. If the instant base was generally aligned with the remainder of the clip, the bottom portions of articles being retain therein would tend to angle away from the user, rather than the item tending to be in a contacting, generally parallel relation to the user. Thus, yet another advantage of the substantially angled base of the instant clip is that items being held generally remain in a contacting and parallel relation to, rather than the bottom portions thereof angling away from, the user. Such a contacting and parallel relation provides for less likelihood that retained articles will be snagged and pulled out of the clip of this invention. The base 202 is further configured so that the gap 228 extends generally parallel to a longitudinal axis 233 of the clip 200. The parallel orientation of the gap 228 facilitates attaching and detaching the clip of this invention, e.g., clip 100 or 190.

The arm 204 extends from the central portion 224 of the base 202 at a curve 240, and has a generally planar portion 242, terminating at a tip 244. The tip 244 may be slightly angled with respect to the planar portion 242 and may be bounded by generally rounded edges. The arm 206 extends from the base 202 by means of an angled portion 250, which adjoins a generally planar portion 252. The planar portion 252 is generally parallel to the planar portion 242 of the arm 204 in the embodiment depicted. The planar portion 252 terminates in a retaining structure such as a generally transverse extension 254. In the embodiment depicted, the extension 254 is generally curved when viewed from the side and terminates at respective inner and outer edges 256 and 258. In the embodiment depicted, the inner edge 256 is proximate, but not contacting, an inner surface 260 of the arm 204. However, in other embodiments the arms 204 and 206 are biased such that the inner edge 256 normally contacts the inner surface 260. Also in the embodiment shown, the arm 206 has a shorter length than the arm 204.

Another embodiment of the second clip is depicted generally at 290. The clip 290 mainly differs from the clip 200 by having generally vertical extensions 292 and 294 from a base 296. As can be seen, the extensions 292 and 294 and the base 296 define the aperture 226. Moreover, the gap 228 is defined generally between the tips 298 and 299 of the respective extensions 292 and 294.

The clip 200 or 290 is secured to a user by forcing the arms 204 and 206 apart, then sliding, e.g., a belt, to a position between the arms 204 and 206. Finally the clip is secured to the belt allowing the arms to return to a closed position. In the closed position, the extension 254 is either proximate to, or contacting, the inner surface of the opposite arm to prevent the instant clip from being accidentally removed from the belt. In use, a user grasps the extension 254 to force the arms 204 and 206 apart, thereby more easily removing the clip 200 or 290 from a garment, e.g., belt, of the user.

Figure 6A:
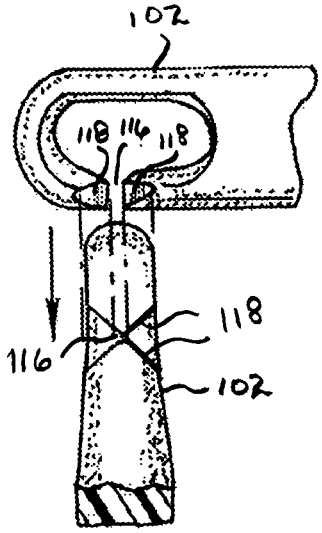
FIG. 6*a* is a perspective view of the clips of this invention being detached from an interlinked position.
Figure 6B:
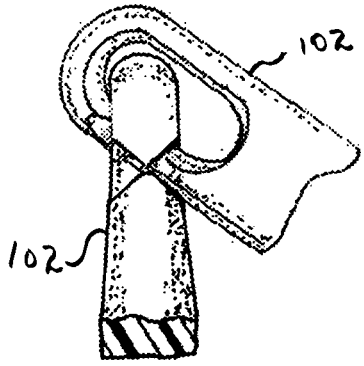
FIG. 6*b* is a perspective view of the clips of this invention in a detachably interlinked position.

Because of the advantageous linking structure of this invention, the instant clips may be detachably linked together. The materials used in making the clips of this invention may impart sufficient flexibility to allow the instant clips to be linked together, or detached, as desired. Moreover, the materials utilized in manufacturing may possess sufficient resilience to retain clips of this invention in a linked configuration when being used. As shown in FIGS. 6*a* and 6*b*, when being linked, the gaps of the clips 100, 190, 200, 290 are aligned. Then sufficient force is applied so that the materials defining (surrounding) the apertures is flexed while the instant clips are either interlinked or detached from each other. The gaps are dimensioned so that the interlocked clips are retained together unless the gaps are aligned and a force is applied to detach the clips by slightly flexing surfaces 118 slightly apart. Indeed, the clips 100, 190, 200, and 290 may be configured so that the gaps 116 and 228 are not aligned when an interlinked clip is hanging from another of the instant clips, which, in turn, is attached to a garment of a user. This non-alignment of the gaps of interlinked clips prevents the clips from becoming accidentally detached during use.

In use, the instant assembly may be employed in two configurations in the embodiments described thus far. In a first configuration, a pair of clips 100 (or 190) are employed. In a second configuration the clip 100 (or 190) is used in combination with the clip 200 (or 290). In the first configuration, two of the clips 100 or 190 are detachably interlinked. One of the clips 100 or 190 may be used to attach the interlinked clips to, e.g., a garment being worn by a user. The other of the clips may be used to retain articles, e.g., gloves 400, not being used. In one example, one of the clips 100 or 190 is attached to the belt loop of the pants of a user and the other of the clips 100 or 190 is used to attach a pair of gloves 400 not being worn. The clips are attached by being grasped such that the user's fingers and thumb exert inward forces on the arms 104 and 106 of the clips, thereby forcing the first jaw portions 132 and 134 apart and out of a closed position. The gloves (or other items) are then inserted between the jaw portions 132 and 134 and the arms 104 and 106 are allowed to return to the closed position, thereby securing the item between the jaw portions 132 and 134. The item is removed by opening the clip to force the jaw portions 132 and 134 apart, thereby allowing the item to be removed from therebetween. Then the arms and jaw portions are allowed to return to the closed position.

In the second embodiment, the clip 200 or 290 is attached to a user's garment, e.g., belt as described above. Then one of clips 100 or 190 is detachably linked to the clip 200 or 290 by aligning the gaps and sliding the clips together so that the rim 110 of the clip 100 or 190 is interlinked with the base of the clip 200 or 290 by being disposed in the aperture 226. Detaching interlinked clips is accomplished by again aligning the gaps and sliding the clips apart. The resiliency of the materials and the dimensions of the gaps require sufficient force to be exerted for detaching, thus otherwise retaining the clips in a detachably linked relation.

Figure 7:
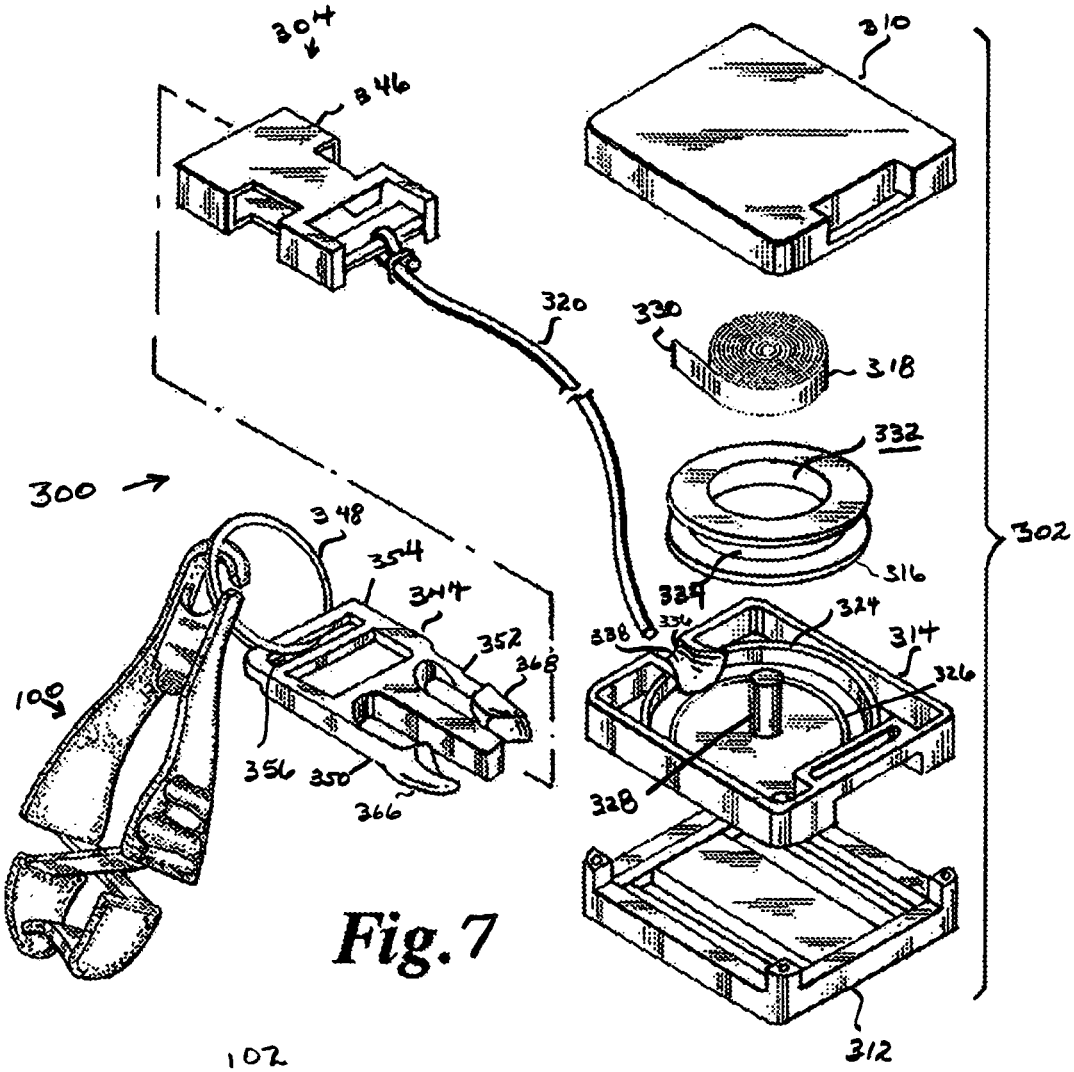
FIG. 7 is an exploded view of the clip of FIG. 1 detachably interlined to a reel mechanism in another operative embodiment of this invention.

Yet another embodiment of this invention is represented in FIG. 7 at 300 and includes a reel subassembly 302 and an optional buckle subassembly 304. The reel subassembly 302, in turn, has respective first (upper) and second (lower) housings 310 and 312, a base 314, a reel 316, a spring 318, and a tether 320. The upper and lower housings 310 and 312, when assembled together, define a cavity, which accommodates the base 314, the reel 316, and the spring 318 operably assembled. While not shown, fasteners such as screws retain the upper and lower housings 310 and 312 in an assembled, or mated, configuration.

The base 314 is dimensioned to be retained between the upper and lower housings 310 and 312. The base 314 retains the reel 316 between a generally circular rim 324 and a tract 326, which is generally concentric to the circular rim 324. In the embodiment shown, the spring 318 is operably wrapped around a post 328 during assembly. And outer end 330 of the reel 316 is attached to an inner surface 332 of the reel 316. The tether 320 is attached to an outer surface 334 of the reel 316 and wound therearound. The tether 320 is wound or unwound from the reel 316 through a path 336 defined by a path member 338 and the housing 310. The reel subassembly 302 is attached, e.g., to a user's belt, by means of a belt clip 340. One suitable exemplary reel assembly is disclosed in U.S. Pat. No. 5,697,572, hereby incorporated by reference.

The optional buckle assembly 304, in the embodiment depicted, includes respective male and female buckle members 344 and 346 and, further optionally, structure for detachably interlinking the clips of this invention such as a ring 348. In place of a generally circular ring, the structure for detachably interlinking the instant clips could be square, polygonal or have any suitable geometry. The male buckle member 344 has prongs 350 and 352 extending from a base 354. The base 354 defines a gap 356. The female buckle member 346 includes a housing 360 with opposed lateral openings 362 and 364. Operationally, the male and female members 344 and 346 are locked together by sliding the male member 344 inside the female member 346 until tips 366 and 368 of the respective prongs 350 and 352 are visible in the openings 362 and 364 of the female member 346. At this point, the prongs 350 and 352 return to an unbiased position with tips 366 and 368 abutting the housing 360 adjacent the openings 362 and 364. The male and female members 344 and 346 are separated by forcing the tips 366 and 368 toward each other, thus forcing the tips 366 and 368 from a contacting disposition with respect to the housing 360, then sliding the male member 344 out of the female member 346. Exemplary buckle members are disclosed in U.S. Pat. Nos. 5,590,444, 3,430,306, and 4,150,464, the entire disclosures of each hereby incorporated by reference.

It should be noted that the buckle assembly may not be present in some embodiments of this invention. If the buckle assembly is not present, the tether 320 may be directly attached to the ring 348. If the ring 348 is also not present, the clip 100 or 190 may be attached directly to the tether 320, e.g., via a loop formed in an end of the tether.

In use, the reel assembly is attached to a user's garment, e.g., belt, by means of the belt clip 340. The clip 100 or 190 may be linked or detached to the ring 348 and to an item to be secured in the same manner as described above. The clip 100 or 190 may be used to secure an item, such as a pair of gloves 400. The clip may be conveniently extended by exerting a force to unwind the tether 320 from the reel 316. When released, the clip is retracted when the tether is rewound on the reel 316 by the spring 318. The presence of the reel assembly allows a user to place the instant clip at almost any desired distance and position when interlinking the instant clip or when attaching detaching an article from the instant clip. Releasing the clip then allows the reel to retract (rewind) the tether so that the clip is disposed adjacent to the reel in a desired position, in which the attached article does not interfere with the activities of the user, but is readily available for use if needed.

Materials suitable for making the instant clips by injection molding include acetyl copolymers, such as polyoxymethylene, available from Hoechst Celanese Corporation. However, a person of ordinary skill in the art will readily understand that other materials may also be suitable. Other suitable materials may be found in the Handbook of Plastics, Elastomers, and Composites, Third Edition, Charles A. Harper, Editor in Chief, McGraw-Hill, New York (1996), its contents hereby incorporated by reference.

Because numerous modifications of this invention may be made without departing from the spirit thereof, the scope of the invention is not to be limited to the embodiments illustrated and described. Rather, the scope of the invention is to be determined by the appended claims and their equivalents.

What is claimed is:

1. A clip, comprising:

a base comprising a rim defining an aperture, the continuity of the base interrupted by a gap opening into the aperture and resiliently admitting a substantially similar base of another clip through the gap wherein a portion of the base of the clip is disposed in an aperture of the other clip and wherein a portion of the base of the other clip is disposed in the aperture of said clip; and first and second arms, each including a gripping portion extending from the base and a first jaw portion in mechanical communication with the gripping portion, the first and second arms biased in a closed position in which the first jaw portions are in a contacting relation, a force exerted on the first and second gripping portions forcing the first jaw portions apart into a non-contacting relation.

2. The clip of claim 1, in which the base further comprises a web and in which the web is characterized by a web length and at least one of the gripping portions is characterized by a gripping portion length and in which a ratio of the gripping portion length and the web length is between about 5 and 15.

3. The clip of claim 1, in which the first jaw portions angle inwardly when the clip is in the contacting relation.

4. The clip of claim 1, in which the base includes a rim and a web bounded by the rim, the web and rim defining the aperture, the rim defining the gap.

5. The clip of claim 4, in which the rim further defines a generally opposed pair of beveled edges bounding the gap.

6. The clip of claim 1, in which the first and second arms further include angular portions extending from the gripping portions.

7. The clip of claim 6, in which the first and second arms further include second jaw portions extending from the angular portions and from the first jaw portions.

8. The clip of claim 1, in which each tip of the first jaw portions includes a slot and a projection generally aligned with the slot.

9. The clip of claim 8, in which the slot of one of said first jaw portions accommodates the projection of the other of said first jaw portions when the clip is in the contacting relation.

10. A clip assembly, comprising:

the clip of claim 1;

a reel assembly including a housing, a reel rotatably disposed in the housing, a spring attached to the reel and the housing, and a tether wound around the reel; and structure for detachably interlinking the clip in mechanical communication with the tether.

11. The clip assembly of claim 10, further including a buckle assembly attached to the tether and the structure for detachably interlinking the clip.

12. The clip assembly of claim 11, in which the buckle assembly comprises male and female buckle members.

13. The clip assembly of claim 12, in which the female buckle member comprises opposing openings and in which the male buckle member comprises a pair of prongs, each of said prongs with an extension disposing in the openings of the female buckle members.

14. A pair of clips, each clip comprising:

a base comprising a central portion and a pair of partially arcuate base extensions, the pair of base extensions extending from the central portion and defining an aperture and a gap, the gap opening into the aperture and separating the base extensions, said clips interlinked by aligning the gaps of said clips, then applying sufficient force to flex the bases, thereby admitting a portion of each base into the aperture of the other clip;

a first arm extending from the base; and a second arm extending from the base.

15. The clip of claim 14, in which the base of one of said clips extends from a clip longitudinal axis at an acute angle.

16. The clip of claim 14, in which the second arm of one of said clip terminates in a generally transverse arm extension.

17. The clip of claim 14, in which portions of the first and second arms of one of said clips are generally planar.

* * * * *